US012487050B2

(12) United States Patent
Liang et al.

(10) Patent No.: US 12,487,050 B2
(45) Date of Patent: Dec. 2, 2025

(54) AIR GUN

(71) Applicant: S-BEAM PRECISION PRODUCTS LIMITED, Zhongshan (CN)

(72) Inventors: Ming Liang, Zhongshan (CN); Xiaoliang Luo, Zhongshan (CN)

(73) Assignee: S-BEAM PRECISION PRODUCTS LIMITED, Zhongshan (CN)

( * ) Notice: Subject to any disclaimer, the term of this patent is extended or adjusted under 35 U.S.C. 154(b) by 94 days.

(21) Appl. No.: 18/539,327

(22) Filed: Dec. 14, 2023

(65) Prior Publication Data

US 2025/0003713 A1 Jan. 2, 2025

(30) Foreign Application Priority Data

Jun. 27, 2023 (CN) ..... 202321644068.4

(51) Int. Cl.
*F41B 11/73* (2013.01)
*F41B 11/62* (2013.01)
*F41B 11/723* (2013.01)

(52) U.S. Cl.
CPC ..... *F41B 11/723* (2013.01); *F41B 11/62* (2013.01); *F41B 11/73* (2013.01)

(58) Field of Classification Search
CPC ..... F41B 11/72; F41B 11/721; F41B 11/723; F41B 11/73; F41B 11/62
See application file for complete search history.

(56) References Cited

U.S. PATENT DOCUMENTS 2,283,300 A * 5/1942 Vincent ..... F41B 11/62 D21/573
2,505,972 A * 5/1950 Johnson ..... F41B 11/723 124/40
3,227,148 A * 1/1966 Spack ..... F41B 11/62 124/76
5,063,905 A * 11/1991 Farrell ..... F41B 11/57 124/72
5,363,834 A * 11/1994 Stuchlik ..... F41B 11/723 124/76
7,069,922 B1 * 7/2006 Orr ..... F41A 23/10 124/73
7,159,585 B2 * 1/2007 Quinn ..... F41B 11/723 124/75
2002/0129806 A1 * 9/2002 Kim ..... F41B 11/62 124/74
2007/0163563 A1 * 7/2007 Gan ..... F41B 11/723 124/73
2016/0153741 A1 * 6/2016 Axelsson ..... F41B 11/723 124/73
2017/0336169 A1 * 11/2017 Axelsson ..... F41B 11/62

* cited by examiner

*Primary Examiner* — Jonathan C Weber
(74) *Attorney, Agent, or Firm* — MATTHIAS SCHOLL P.C.; Matthias Scholl

(57) ABSTRACT

An air gun, includes: a cartridge including a launching chamber, a cylinder including an air chamber, an air valve, a first pin, and a second pin. The air valve is disposed in the air chamber and partially extends out of the cylinder to connect to the cartridge; the air valve is an integrally-formed structure and includes an air passage comprising an air inlet and an air outlet; the air inlet is connected to the air chamber, the air outlet is connected to the launching chamber; the first pin is movable relative to the cylinder to open and close the air inlet, and the second pin is movable relative to the cylinder to open and close the air outlet.

7 Claims, 5 Drawing Sheets

AIR GUN

CROSS-REFERENCE TO RELATED APPLICATIONS

Pursuant to 35 U.S.C. § 119 and the Paris Convention Treaty, this application claims foreign priority to Chinese Patent Application No. 202321644068.4 filed Jun. 27, 2023, the contents of which, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, MA 02142.

BACKGROUND

The disclosure relates to an air gun.

The air guns provide compressed air to bullets inside the cartridge and launch the bullets. Typically, an air gun includes at least a cartridge, a cylinder, and an air valve connecting the cartridge and the cylinder. The cartridge communicates or does not communicate with the cylinder according to the working status of the air valve. The existing air valve is composed of multiple components, and the connection and installation of the components are arduous, difficult, and inefficient.

SUMMARY

The disclosure provides an air gun, comprising: a cartridge comprising a launching chamber, a cylinder comprising an air chamber, an air valve, a first pin, and a second pin. The air valve is disposed in the air chamber and partially extends out of the cylinder to connect to the cartridge; the air valve is an integrally-formed structure and comprises an air passage comprising an air inlet and an air outlet; the air inlet is connected to the air chamber; the air outlet is connected to the launching chamber; the first pin is movable relative to the cylinder to open and close the air inlet, and the second pin is movable relative to the cylinder to open and close the air outlet.

In a class of this embodiment, the air valve comprises a first connection column, a connection block, and a second connection column; the first connection column is disposed in the air chamber and is fixedly connected to the cylinder in a detachable manner; the second connection column is fixedly connected to the cartridge in a detachable manner, and the connection block is connected to the first connection column and the second connection column, and is integrally formed with the first connection column and the second connection column.

In a class of this embodiment, an outer circumference of the first connection column comprises a plurality of counterbores; the cylinder comprises a plurality of through holes corresponding to the plurality of counterbores one by one; a fastener is disposed in each of the plurality of through holes; and the fastener is configured to fix and position the first connection column on the cylinder.

In a class of this embodiment, the air passage comprises a first passage, a second passage, and a third passage; the first passage is disposed on the first connection column and axially extends in the first connection column; the third passage is disposed on the second connection column and extends axially in the second connection column; the first pin is disposed on the first connection column and is capable of moving along the first passage to open and close the air inlet; the air outlet is disposed on the third passage, and the second pin is disposed on the cylinder and is capable of moving along the cylinder to open and close the air outlet.

In a class of this embodiment, the third passage is disposed through the second connection column, and the cartridge extends axially into the second connection column from one side of the third passage; the second pin extends axially into the second connection column from the other side of the third passage; a sliding seat is disposed on the cylinder and the second pin is connected to the sliding seat; the sliding seat is movable between a first position and a second position; when the sliding seat moves to the first position, the second pin closes the air outlet; and when the sliding seat moves to the second position, the second pin opens the air outlet.

In a class of this embodiment, the first passage is disposed through the first connection column, and a first driving unit and a second driving unit are disposed axially on two ends of the first passage, respectively; the second driving unit is movable along the cylinder between a third positon and a fourth position; in the third positon, the second driving unit butts against the first pin and the first pin opens the air inlet; in the fourth position, the second driving unit is disconnected with the first pin, and the first pin closes the air inlet.

In a class of this embodiment, when the first pin closes the air inlet, one end of the first pin away from the first driving unit extends out of the first connection column; when the second driving unit moves from the fourth position to the third position, the second driving unit drives the first pin to open the air inlet.

In a class of this embodiment, the first driving unit comprises a connecting cylinder and a first elastic piece; the connecting cylinder is in threaded connection to the connection column and comprises a first assembly chamber; the first assembly chamber communicates with the first passage and the air chamber; the first elastic piece is disposed in the first assembly chamber and butts against the first pin; the first elastic piece is elastically contractive in a movement direction of the first pin, to drive the first pin to move towards the second driving unit and extend out of the connection column.

In a class of this embodiment, the second driving unit comprises a sliding block and a second elastic piece; the sliding block comprises a second assembly chamber; the second assembly chamber is opened on one side of the sliding block away from the first pin, and the second elastic piece is disposed in the second assembly chamber and butts against the cylinder; a trigger is disposed on the cylinder and is rotatable with a joint of the trigger and the cylinder as an axis to engage with or detach from the sliding block; when the trigger detaches from the sliding block, the sliding block is driven by the second elastic piece to butt against the first pin, and the first pin moves to open the air inlet; when the trigger engages with the sliding block, the sliding block detaches from the first pin, and the first pin is driven by the first driving unit to move and close the air inlet.

In a class of this embodiment, a sealing sleeve is disposed in the first passage; the sealing sleeve surrounds the first pin and is adjacent to the air inlet; an outer wall of the sealing sleeve comprises an annular groove, and a seal ring is disposed in the annular groove.

The following advantages are associated with the air gun of the disclosure:

The air valve of the disclosure is integrally formed, thus simplifying the production and assembly of the air valve, and reducing the difficulty of assembling the air gun and increasing the efficiency of assembling the air gun. Furthermore, the air valve comprises the air passage connecting the air chamber and the launching chamber, and the first pin and the second pin are capable of moving relative to the cylinder to open and close the air passage, to achieve the launching and waiting to be launched of the air gun.

DETAILED DESCRIPTION

To further illustrate the disclosure, embodiments detailing an air gun are described below. It should be noted that the following embodiments are intended to describe and not to limit the disclosure.

Figure 1:
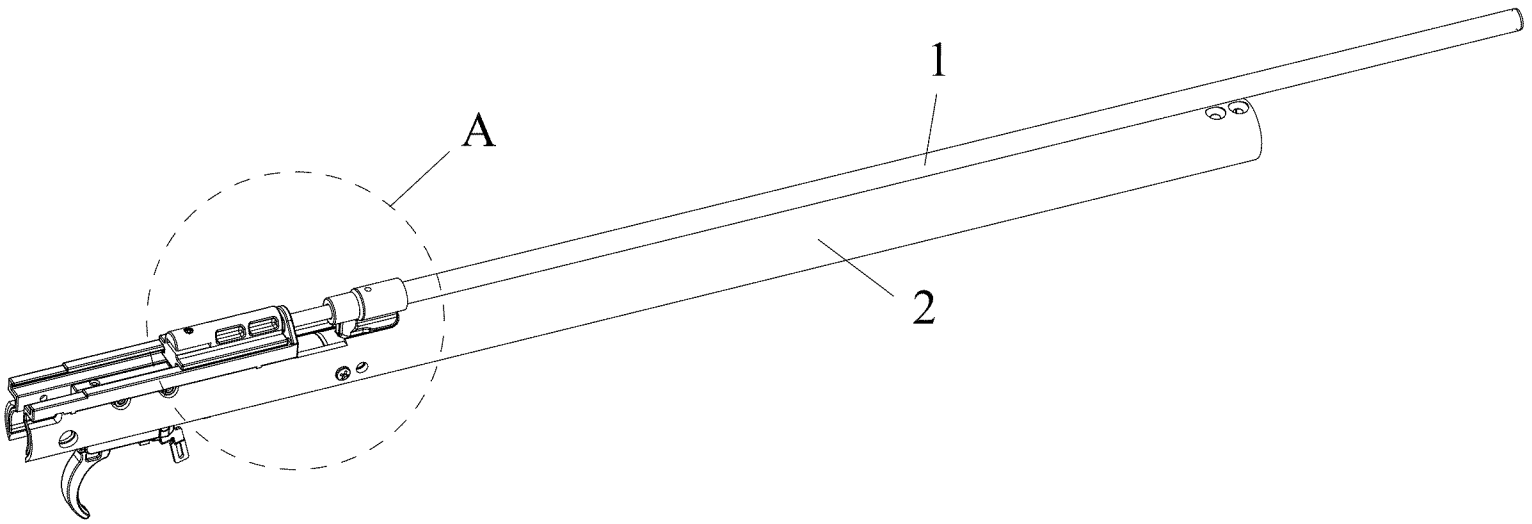
FIG. 1 is a stereograph of an air gun of the disclosure.
Figure 2:
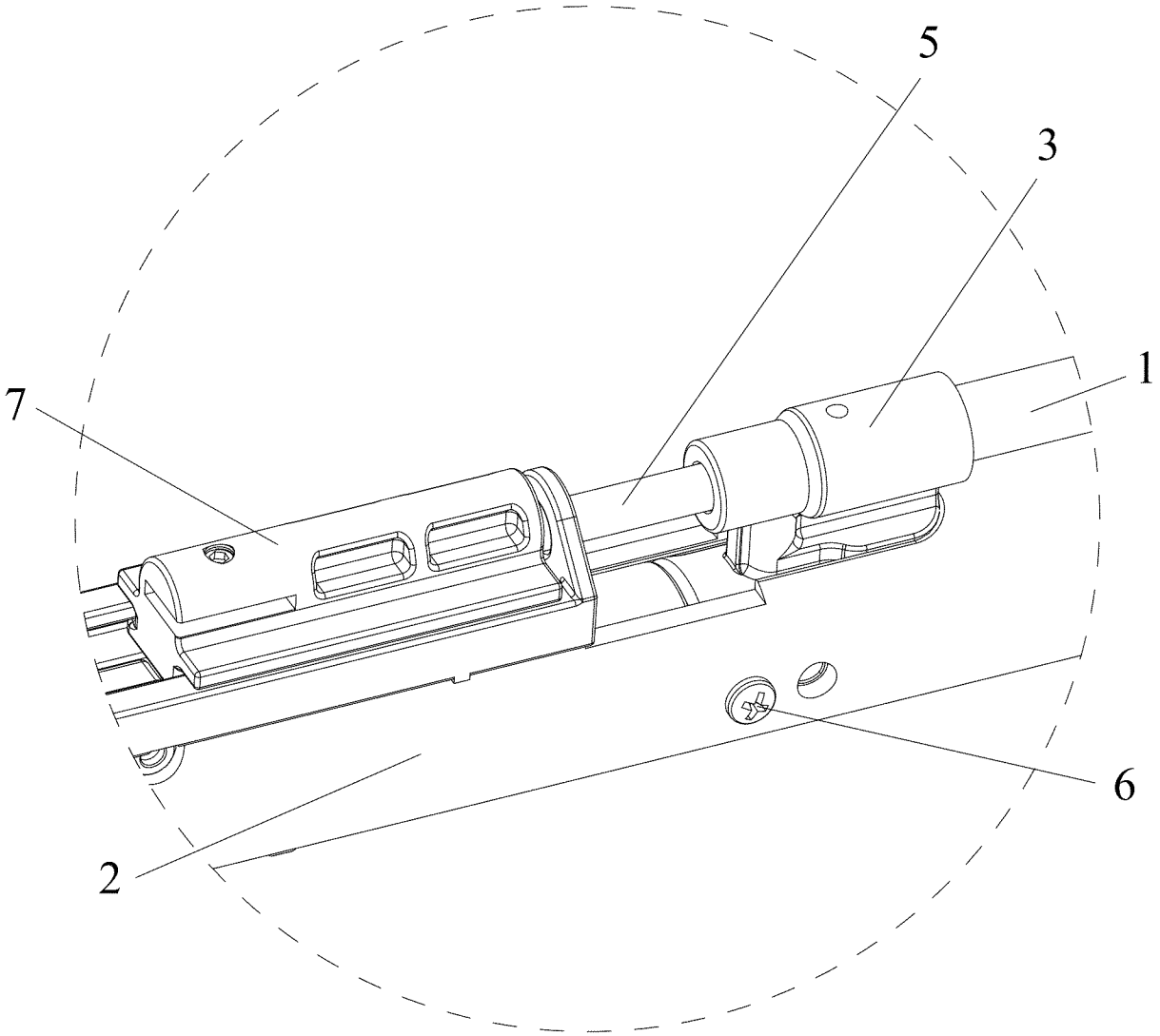
FIG. 2 is a local enlarged view of part A in FIG. 1.
Figure 3:
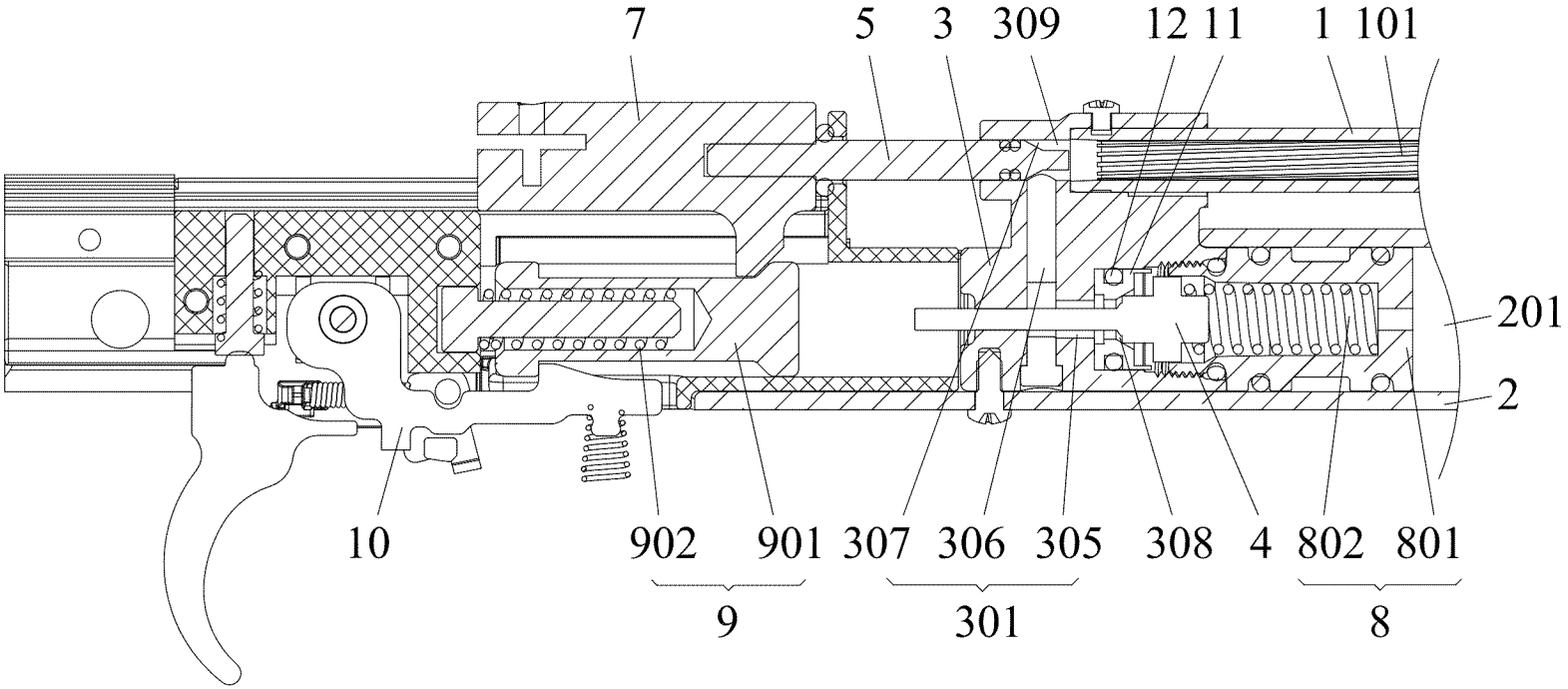
FIG. 3 is a sectional view of an air gun of the disclosure.
Figure 4:
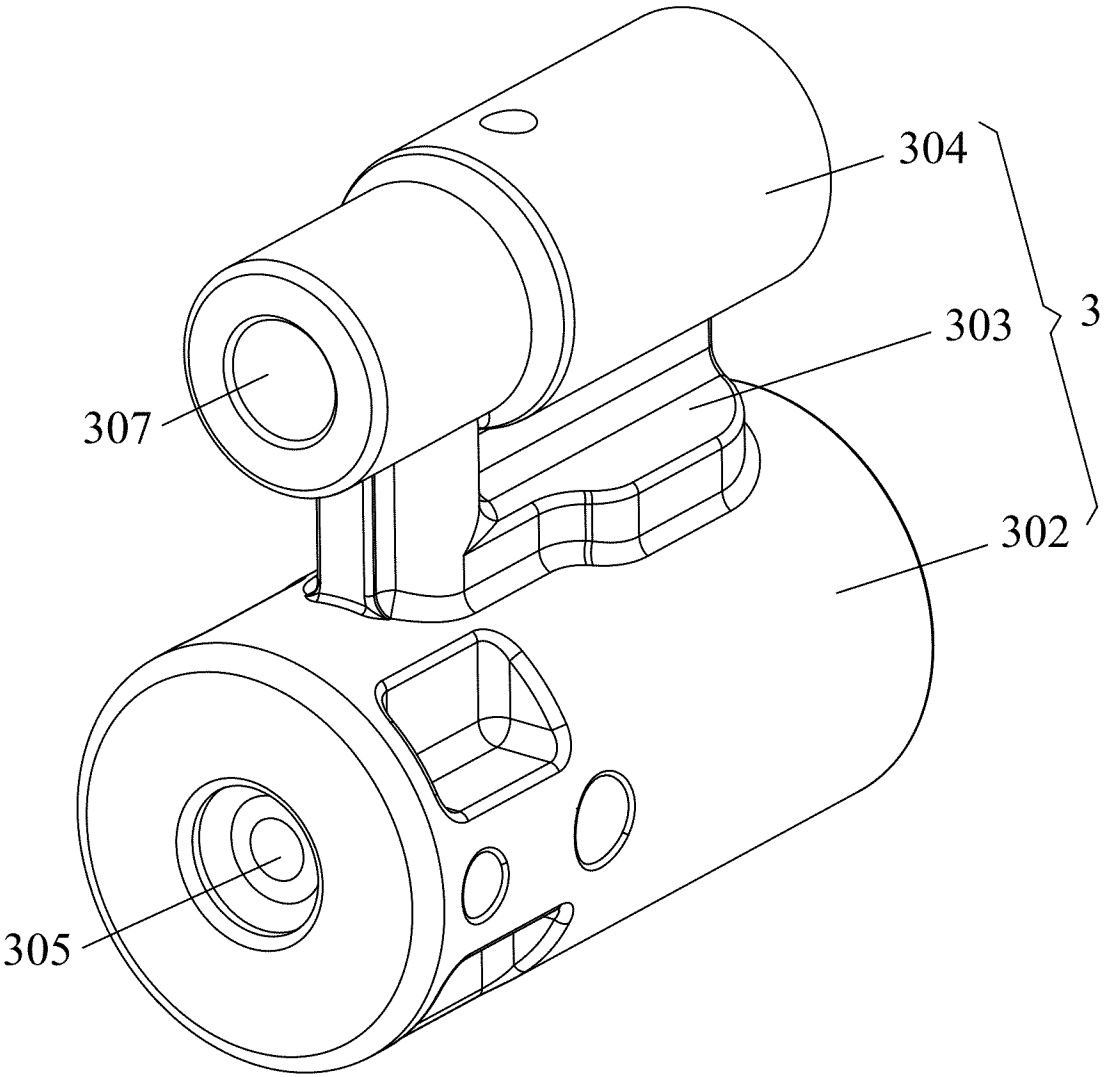
FIG. 4 is a stereograph of an air valve of the disclosure.
Figure 5:
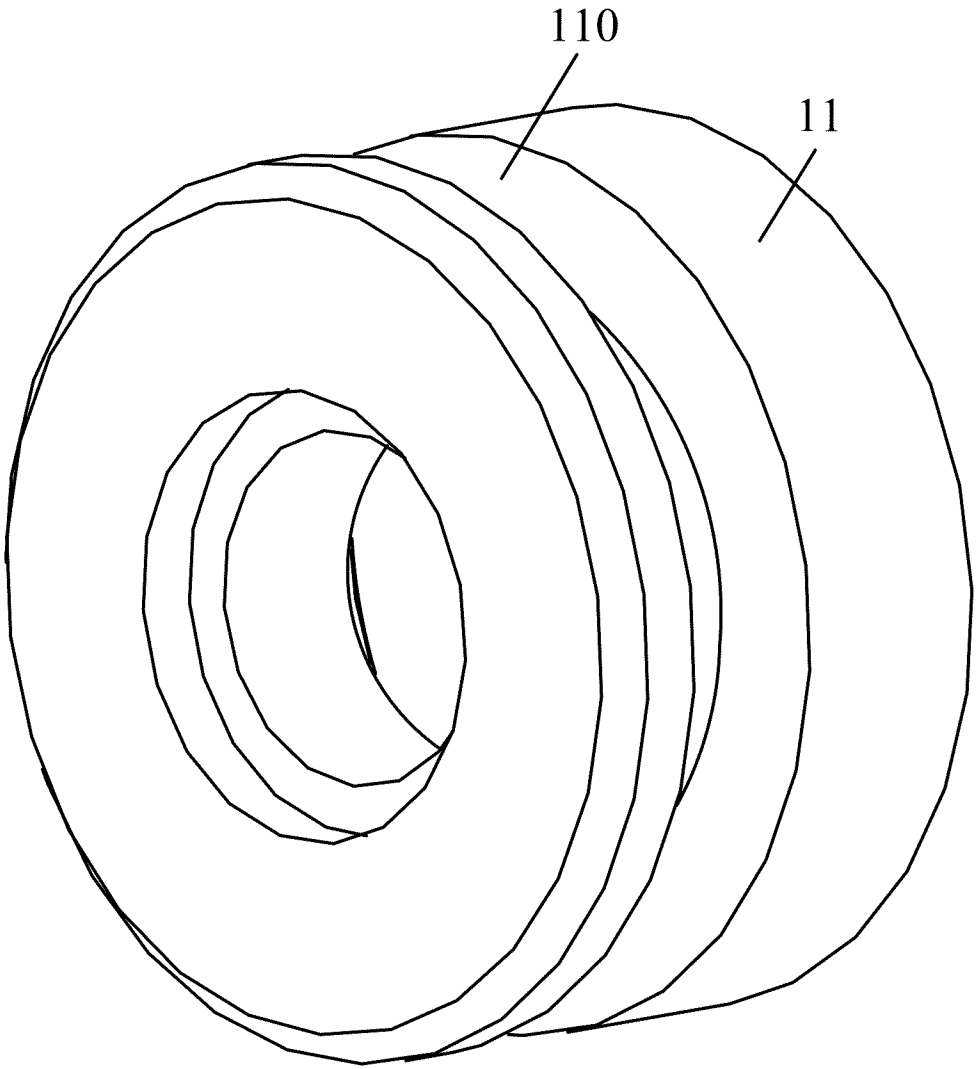
FIG. 5 is a stereograph of a seal ring of the disclosure.

As shown in FIGS. 1-5, the disclosure provides an air gun comprising a cartridge 1 and a cylinder 2. The cartridge 1 comprises a launching chamber 101, and the cylinder 2 comprises an air chamber 201. The air gun further comprises an air valve 3, a first pin 4, and a second pin 5. The air valve is disposed in the air chamber and partially extends out of the cylinder to connect to the cartridge; the air valve is an integrally-formed structure and comprises an air passage 301 comprising an air inlet 308 and an air outlet 309; the air inlet 308 is connected to the air chamber; the air outlet 309 is connected to the launching chamber; the first pin 4 is movable relative to the cylinder 2 to open and close the air inlet 308, and the second pin 5 is movable relative to the cylinder 2 to open and close the air outlet 309. When the first pin 4 opens the air inlet 308 and the second pin 5 opens the air outlet 309, the high-pressure air in the air chamber 201 enters the launching chamber 101 via the air passage 301, so that the bullets in the launching chamber 101 are ejected out of the cartridge 1, thus realizing the launching of the bullets. When the first pin 4 closes the air inlet 308, the first pin 4 prevents the high-pressure gas from entering the air passage 301, and the air gun is in the state of being ready to be launched. The disclosure provides the air gun to solve the problem that the air valve in the conventional air gun is composed of multiple parts, which is complicated and difficult to assemble with low efficiency. The air valve 3 of the disclosure is integrally formed, thus simplifying the production and assembly of the air valve 3, thereby reducing the difficulty of assembling the air gun and increasing the efficiency of assembling the air gun. Furthermore, the air valve 3 comprises the air passage 301 connecting the air chamber 201 and the launching chamber 101, and the first pin 4 and the second pin 5 are capable of moving relative to the cylinder 2 to open and close the air passage 301, to achieve the launching and waiting to be launched of the air gun.

Optionally, the air valve 3 comprises a first connection column 302, a connection block 303, and a second connection column 304; the first connection column 302 is disposed in the air chamber 201 and is fixedly connected to the cylinder 2 in a detachable manner; the second connection column 304 is fixedly connected to the cartridge 1 in a detachable manner, and the connection block 303 is connected to the first connection column 302 and the second connection column 304, and is integrally formed with the first connection column 302 and the second connection column 304. Since the air valve 3 comprises the first connection column 302 fixedly connected to the cylinder 2 in a detachable manner, the second connection column 304 fixedly connected to the cartridge 1 in a detachable manner, and the connection block 303 connected to the first connection column 302 and the second connection column 304, the connections between the air valve 3 and the cylinder 2, and between the air valve 3 and the cartridge 1 are stabilized and easy to disassemble.

Optionally, the outer circumference of the first connection column 302 comprises a plurality of counterbores (not shown in the drawings); the cylinder 2 comprises a plurality of through holes (not shown in the drawings) corresponding to the plurality of counterbores one by one; a fastener 6 is disposed in each of the plurality of through holes; and the fastener 6 is configured to fix and position the first connection column 302 on the cylinder 2. Since the first connection column 302 is connected to the cartridge 2 by the fastener 6, it is easy to mount and dismount the first connection column 302 from the cartridge 2.

Optionally, the air passage 301 comprises a first passage 305, a second passage 306, and a third passage 307; the first passage 305 is disposed on the first connection column 302 and axially extends in the first connection column 302; the third passage 307 is disposed on the second connection column 304 and extends axially in the second connection column 304; the first pin 4 is disposed on the first connection column 302 and is capable of moving along the first passage 305 to open and close the air inlet 308; the air outlet 309 is disposed on the third passage 307, and the second pin 5 is disposed on the cylinder 2 and is capable of moving along the cylinder 2 to open and close the air outlet 309. The air passage 301 comprises the first passage 305 axially extending in the first connection column 302, the third passage 307 extending axially in the second connection column 304, and the second passage 306 connecting the first passage 305 and the third passage 307, thus facilitating the arrangement of the air passage 301 and the installation of the first pin 4 and second pin 5.

Optionally, the third passage 307 is disposed through the second connection column 304, and the cartridge 1 extends axially into the second connection column 304 from one side of the third passage 307; the second pin 5 extends axially into the second connection column 304 from the other side of the third passage 307; a sliding seat 7 is disposed on the cylinder 2 and the second pin 5 is connected to the sliding seat 7; the sliding seat 7 is movable between a first position and a second position; when the sliding seat 7 moves to the first position, the second pin 5 closes the air outlet 309; and when the sliding seat 7 moves to the second position, the second pin 5 opens the air outlet 309. Since the cylinder 2 is provided with the sliding seat 7, the second pin 5 is able to open or close the air outlet 309 when the sliding seat 7 moves to the first position or the second position, and the design is simple and easy to implement.

Optionally, the first passage 305 is disposed through the first connection column 302, and a first driving unit 8 and a second driving unit 9 are disposed axially on two ends of the first passage 305, respectively; the second driving unit 9 is movable along the cylinder 2 between a third positon and a fourth position; in the third positon, the second driving unit 9 butts against the first pin 4 and the first pin 4 opens the air inlet 308; in the fourth position, the second driving unit 9 is disconnected with the first pin, and the first pin 4 closes the air inlet 308. When the first pin 4 closes the air inlet 308, one end of the first pin 4 away from the first driving unit 8 extends out of the first connection column 302; when the second driving unit 9 moves from the fourth position to the third position, the second driving unit 9 drives the first pin 4 to open the air inlet 308. Since the two axial sides of the first passage 305 are provided with the first driving unit 8 and the second driving unit 9 to drive the first pin 4 to open or close the air inlet 308, the first pin 4 is able to open or close the air outlet 309, and the structure is simple and easy to implement.

Optionally, the first driving unit 8 comprises a connecting cylinder 801 and a first elastic piece 802; the connecting cylinder 801 is in threaded connection to the connection column 302 and comprises a first assembly chamber; the first assembly chamber communicates with the first passage 305 and the air chamber 201; the first elastic piece 802 is disposed in the first assembly chamber and butts against the first pin 4; the first elastic piece 802 is elastically contractive in a movement direction of the first pin 4, to drive the first pin 4 to move towards the second driving unit 9 and extend out of the connection column 302.

Optionally, the second driving unit 9 comprises a sliding block 901 and a second elastic piece 902; the sliding block 901 comprises a second assembly chamber; the second assembly chamber is opened on one side of the sliding block 901 away from the first pin 4, and the second elastic piece 902 is disposed in the second assembly chamber and butts against the cylinder 2; a trigger 10 is disposed on the cylinder 2 and is rotatable with a joint of the trigger and the cylinder as an axis to engage with or detach from the sliding block 901; when the trigger 10 detaches from the sliding block 901, the sliding block 901 is driven by the second elastic piece 902 to butt against the first pin 4, and the first pin moves to open the air inlet 308; when the trigger 10 engages with the sliding block 901, the sliding block 901 detaches from the first pin 4, and the first pin 4 is driven by the first driving unit 8 to move and close the air inlet 308.

Optionally, a sealing sleeve 11 is disposed in the first passage 305; the sealing sleeve surrounds the first pin 4 and is adjacent to the air inlet 308; an outer wall of the sealing sleeve 11 comprises an annular groove 110, and a seal ring 12 is disposed in the annular groove 110. Since the first passage 305 is provided with the sealing sleeve 11 around the first pin 4 and adjacent to the air inlet 308, the first pin 4 features high air tightness when closing the air inlet 308. Optionally, the annular groove 110 is disposed in the middle of the sealing sleeve 11 so that the sealing sleeve 11 is more airtight.

It will be obvious to those skilled in the art that changes and modifications may be made, and therefore, the aim in the appended claims is to cover all such changes and modifications.

What is claimed is:

1. An air gun, comprising:

a cartridge comprising a launching chamber;

a cylinder comprising an air chamber;

an air valve;

a first pin; and a second pin;

wherein:

the air valve is disposed in the air chamber and partially extends out of the cylinder to connect to the cartridge;

the air valve is a single, integrally formed structure and comprises a first connection column, a second connection column, and a connection block; the connection block is connected to the first connection column and the second connection column and is integrally formed with the first connection column and the second connection column; and an air passage comprising an air inlet and an air outlet is disposed within the air valve;

the air passage further comprises a first passage, a second passage, and a third passage; the first passage axially extends within the first connection column; the third passage axially extends within the second connection column; and the second passage extends through the connection block and communicates the first passage with the third passage;

the first connection column is disposed in the air chamber and detachably connected to the cylinder, and the second connection column is detachably connected to the cartridge;

the air inlet is configured to communicate the air chamber with the first connection column;

the air outlet is configured to communicate the launching chamber with the second connection column; and the first pin is disposed through the first connection column and is movable relative to the cylinder to open and close the air inlet;

the cartridge extends axially into the second connection column from a first opening of the third passage;

the second pin has a solid structure and extends axially into the second connection column from a second opening of the third passage; and a sliding seat is disposed on the cylinder; the second pin is connected to the sliding seat; the sliding seat is movable between a first position and a second position;

when the sliding seat is in the first position, the second pin is positioned within the launching chamber and closes the air outlet; and when the sliding seat is in the second position, the second pin is retracted from the launching chamber and opens the air outlet.

2. The air gun of claim 1, wherein an outer circumference of the first connection column comprises a plurality of counterbores; the cylinder comprises a plurality of through holes corresponding to the plurality of counterbores one by one; a fastener is disposed in each of the plurality of through holes; and the fastener is configured to fix and position the first connection column on the cylinder.

3. The air gun of claim 2, wherein the first passage is disposed through the first connection column, and a first driving unit and a second driving unit are disposed axially on two ends of the first passage, respectively; the second driving unit is movable along the cylinder between a third position and a fourth position; in the third position, the second driving unit butts against the first pin and the first pin opens the air inlet; in the fourth position, the second driving unit is disconnected with the first pin, and the first pin closes the air inlet.

4. The air gun of claim 3, wherein when the first pin closes the air inlet, one end of the first pin away from the first driving unit extends out of the first connection column; when the second driving unit moves from the fourth position to the third position, the second driving unit drives the first pin to open the air inlet.

5. The air gun of claim 3, wherein the first driving unit comprises a connecting cylinder and a first elastic piece; the connecting cylinder is in threaded connection to the connection column and comprises a first assembly chamber; the first assembly chamber communicates with the first passage and the air chamber; the first elastic piece is disposed in the first assembly chamber and butts against the first pin; the first elastic piece is elastically contractive in a movement direction of the first pin, to drive the first pin to move towards the second driving unit and extend out of the connection column.

6. The air gun of claim 3, wherein the second driving unit comprises a sliding block and a second elastic piece; the sliding block comprises a second assembly chamber; the second assembly chamber is opened on one side of the sliding block away from the first pin, and the second elastic piece is disposed in the second assembly chamber and butts against the cylinder; a trigger is disposed on the cylinder and is rotatable with a joint of the trigger and the cylinder as an axis to engage with or detach from the sliding block; when the trigger detaches from the sliding block, the sliding block is driven by the second elastic piece to butt against the first pin, and the first pin moves to open the air inlet; when the trigger engages with the sliding block, the sliding block detaches from the first pin, and the first pin is driven by the first driving unit to move and close the air inlet.

7. The air gun of claim 2, wherein a sealing sleeve is disposed in the first passage; the sealing sleeve surrounds the first pin and is adjacent to the air inlet; an outer wall of the sealing sleeve comprises an annular groove, and a seal ring is disposed in the annular groove.

* * * * *